US005567019A

United States Patent [19]

Raza et al.

[11] Patent Number: 5,567,019

[45] Date of Patent: Oct. 22, 1996

[54] WHEEL FOR IN-LINE ROLLER SKATES

[75] Inventors: Irfan F. Raza, Utica; Thomas F. Preczewski, New Baltimore; Ronald D. Walther, Algonac, all of Mich.

[73] Assignee: U.S. Farathane Corporation, Utica, Mich.

[21] Appl. No.: 311,354

[22] Filed: Sep. 23, 1994

[51] Int. Cl.[6] ..... A63C 7/06

[52] U.S. Cl. ..... 301/5.3; 301/64.7

[58] Field of Search ..... 301/5.3, 5.7, 64.7; 280/11.19, 11.22, 11.23

[56] References Cited

U.S. PATENT DOCUMENTS 5,028,058 7/1991 Olson ..... 280/11.22

5,312,844 5/1994 Gonsior et al. ..... 301/5.3 X 5,362,075 11/1994 Szendel ..... 301/5.7 X

*Primary Examiner*—Russell D. Stormer

*Attorney, Agent, or Firm*—Lalos & Keegan

[57] ABSTRACT

A wheel construction generally consisting of a hub section formed of a thermoplastic polyurethane material having a first durometer hardness and a rim section formed of a thermoplastic polyurethane material having a second durometer hardness less than the first durometer hardness, molded onto the hub section to form a molecularly adhered, integral hub and rim structure.

29 Claims, 1 Drawing Sheet

WHEEL FOR IN-LINE ROLLER SKATES

BACKGROUND OF THE INVENTION

This invention relates to a wheel construction and more particularly to a wheel suitable for use in in-line roller skates used for recreational purposes. This invention further relates to a novel method of making such wheel construction.

Recently, there has been developed a type of roller skate commonly refereed to as an in-line roller skate which has experienced a widespread usage for recreational purposes. The skate generally consists of a shoe portion, a pair of spaced, longitudinally disposed rails depending from the sole portion of the shoe and a plurality of roller wheels spaced longitudinally between the rails and mounted on axles supported on the rails. Typically, the roller wheels used on such skates have included a hub portion having a bearing mounted on an axle, and a tire portion mounted on and secured to the periphery of the hub portion of the skate. Preferably, the hub portion has been formed of material providing high dimensional stability, strength and hardness, and the hub portion has been formed of a material providing low rolling resistance, good wear characteristics and non-skid properties. Various materials and combinations of materials have been used for the hub and tire portions of such wheels with the tire portions of the wheels being formed integrally with the tire portions, detachably secured to the hub portions, mechanically interlocked to the hub portions and fused and otherwise bonded thereto. It has been found, however, that such prior art wheel constructions have not been entirely satisfactory in performance, typically providing high rolling resistance, undue wear and/or loss of resilience under repetitive loading. It thus further has been found to be desirable to provide a novel wheel construction suitable for use in in-line roller skates which not only has a hub portion of high dimensional stability, strength and hardness but a tire portion which has a low rolling resistance, good wear resistance and a low loss of resilience under repetitive loading to provide an efficient and comfortable ride for the user.

Accordingly, the principal object of the present invention is to provide an improved wheel construction.

Another object of the present invention is to provide an improved wheel suitable for use in an in-line skate.

A further object of the present invention is to provide an improved wheel construction suitable for use in an in-line skate having a high dimensional stability, low rolling resistance, a low loss of resilience under repetitive loading and durability.

A still further object of the present invention is to provide an improved wheel for an in-line skate, having a hub portion and a tire portion rigidly secured to the hub portion.

Another object of the present invention is to provide an improved wheel for an in-line roller skate having a hub portion having high dimensional stability, strength and hardness and a tire portion formed integrally with such hub portion and having a low rolling resistance, a low loss of resilience under repetitive loading and a high durability.

A further object of the present invention is to provide an improved wheel for an in-line roller skate which is simple in design, easy to manufacture and effective in performance.

Another object of the present invention is to provide a novel method of making a wheel suitable for use in an in-line skate.

A further object of the present invention is to provide an improved in-line skate suitable for use for recreational purposes.

Other objects and advantages of the present invention will become more apparent to those persons having ordinary skill in the art to which the present invention pertains from the following description taken in conjunction with the accompanying drawing in which:

DESCRIPTION OF THE PREFERRED EMBODIMENT

Figure 1:
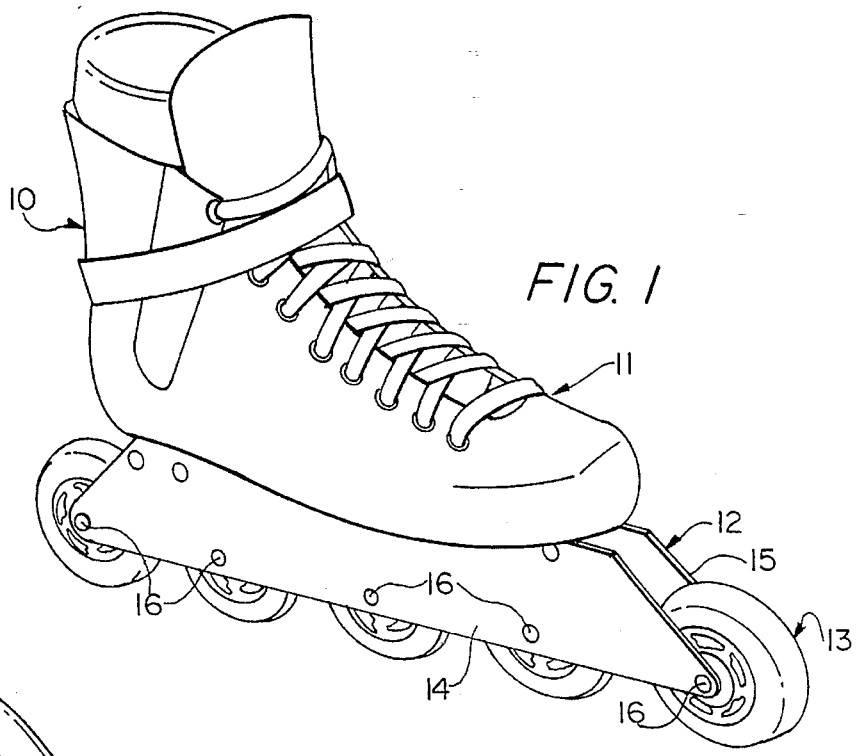
FIG. 1 is a perspective view of an in-line skate embodying the present invention.

Referring to FIG. 1 of the drawing, there is shown a skate 10 which includes a shoe 11, a wheel support member 12 and a plurality of roller wheels 13. The shoe portion of the skate may be of any suitable construction such as a conventional roller skate or ice skate shoe or even a ski boot. The wheel support member is mounted on the bottom of the shoe and includes a plate portion (not shown) rigidly secured to the sole of the shoe and a pair of longitudinally disposed, transversely spaced rails 14 and 15 rigidly secured at their upper ends to the base plate of the member and depending therefrom as shown in FIG. 1. Longitudinally spaced along the lower edges of the rails are a plurality of transversely opposed openings in which there are journaled a plurality of wheel axles 16.

Figure 2:
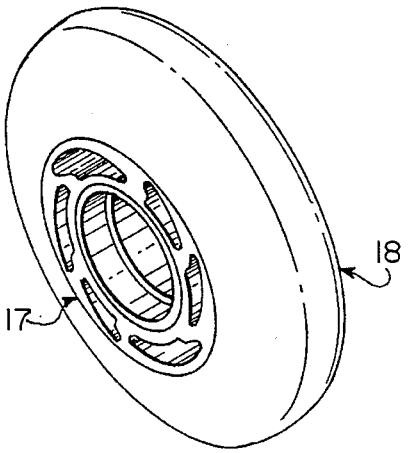
FIG. 2 is an enlarged perspective view of a wheel used in the skate shown in FIG. 1.
Figure 3:
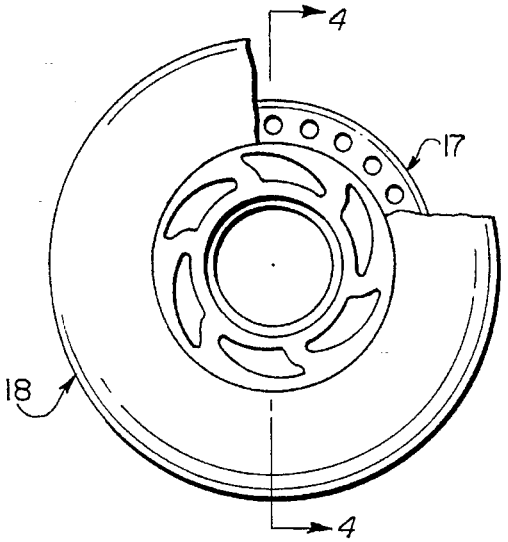
FIG. 3 is an enlarged side view of a wheel used in the skate shown in FIG. 1, having a portion thereof broken away.
Figure 4:
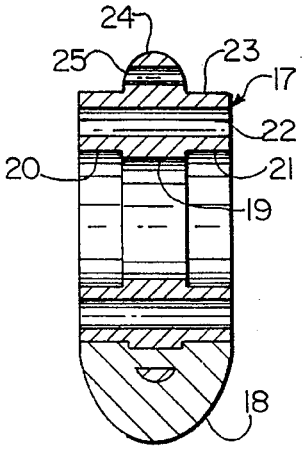
FIG. 4 is a cross-sectional view taken along line 4—4 in FIG. 1.

As best shown in FIGS. 2, 3 and 4, each wheel consists of a hub section 17 and a tire section 18. Each of the hub sections is provided with an axial opening 19 having a pair of enlarged portions 20 and 21 for receiving a set of bearings (not shown). The hub section further is provided with a plurality of circumferentially spaced openings 22 which are disposed concentrically relative to axial opening 19. The outer peripheral portion of the hub is provided with an annular surface 23 and an annular, radially projecting portion 24. The annular projecting portion further is provided with a plurality of circumferentially spaced openings 25.

The hub section is formed of a polyether based polyurethane material having a durometer hardness in the range of 65 to 78 Shore D, and preferably a durometer hardness of 72 Shore D. A durometer hardness of 72 Shore D is achieved by using an additive such as fiberglass, as hereinafter described. Such material provides a high dimensional stability, strength and hardness suitable for use in such a skate construction.

The tire section of the wheel also is formed of a polyether based polyurethane material and is formed by molding such section onto the hub section so that a portion of the tire section will be received within openings 25 in annular portion 24 of the hub section to physically interlock the tire section to the hub section. Because they are made of the same material base, the interfacing surfaces of the tire and hub sections will fuse and be bonded together to provide a molecular adhesion between the two sections.

The tire section of each wheel is formed of a polyether based polyurethane material having a durometer hardness in the range of 28 to 35 Shore D and preferably a durometer hardness of 30 Shore D. Such material will provide the outer tire section with low rolling resistance, a low loss of resilience under repetitive loading and high durability.

In the manufacture of the wheel as described, the hub portion initially is formed by injecting a molten polyether based polyurethane material having a durometer hardness in tile range of 65 to 78 Shore D into a mold cavity, utilizing processing temperatures of approximately 400° F. Then, the hub section is transferred to a second mold cavity in which there is injected a molten, polyether based polyurethane material having a durometer hardness in the range of 28 to 35 Shore D, into contact with the hub section, utilizing processing temperatures of approximately 380° F. The injection of the molten tire section material into the second mold cavity containing the hub section causes the tire section to fuse or bond with the hub section to provide a molecular adhesion between the two sections. When the wheel thus formed is removed from the second mold cavity and allowed to cool, the resultant wheel will be provided with a tire section not only physically interlocked but molecularly adhered to the hub section.

The wheel formed by the method as described will be provided with a hub section that is dimensionally stable, strong and hard, an attachment of the tire section to the hub section which is firmly intact and a tire section which has a low rolling resistance, a low loss of resilience under repetitive loading and high durability. Because thermoplastic polyurethane materials provide low energy consumption and low heat build up and are viscoelastic, during competitive loading of the wheel, the rebound energy is neither absorbed or dissipated as heat and is conserved to provide a rebound resilience of the wheel. Such characteristics of the wheel provide not only durability and a protracted service life but also increased comfort to the user.

In addition to the use of a polyether based polyurethane material for both the hub and tire sections of the wheel, it further is preferred to provide the hub section with an additive such as fiberglass to enhance its properties. It has been found that the addition of fiberglass particles in the range of 15% to 30% by weight and preferably 20% by weight greatly enhances the properties and performance of the hub section of the wheel. Other additives also may be provided in the hub or tire sections of the wheel depending upon the properties sought which is well known in the art.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A wheel construction comprising:

a hub section formed of a thermoplastic polyurethane material having a first durometer hardness; and a tire section formed of a thermoplastic polyurethane material having a second durometer hardness, molded onto said hub section to form a molecularly adhered, integral hub and tire structure.

2. A wheel construction according to claim 1 wherein said hub and tire sections are formed of a polyether based polyurethane material.

3. A wheel construction according to claim 1 wherein the hardness of said hub section is greater than the hardness of said tire section.

4. A wheel construction according to claim 1 wherein the durometer hardness of the hub section material is in the range of 65 to 78 Shore D.

5. A wheel construction according to claim 1 wherein the durometer hardness of the hub section material is 72 Shore D.

6. A wheel construction according to claim 1 wherein the durometer hardness of the tire section material is in the range of 28 to 35 Shore D.

7. A wheel construction according to claim 1 wherein the durometer hardness of the tire section material is 30 Shore D.

8. A wheel construction according to claim 1 wherein the durometer hardness of the hub section material is in the range of 65 to 78 Shore D and the durometer hardness of the tire section material is in the range of 28 to 35 Shore D.

9. A wheel construction according to claim 1 wherein the durometer hardness of the hub section material is 72 Shore D and the durometer hardness of the tire section material is 30 Shore D.

10. A wheel construction according to claim 1 wherein said hub section includes an additive.

11. A wheel construction according to claim 10 wherein said additive consists of fiberglass particles.

12. A wheel construction according to claim 10 wherein said additive consists of fiberglass particles in the range of 15% to 30% by weight.

13. A wheel construction according to claim 10 wherein the hub portion has a durometer hardness in the range of 65 to 78 Shore D and the tire section has a durometer hardness in the range of 28 to 35 Shore D.

14. A wheel construction according to claim 13 wherein the additive consists of fiberglass particles.

15. A wheel construction according to claim 10 wherein the hub section has a durometer hardness of 72 Shore D and the tire section has a durometer hardness of 30 Shore D.

16. A wheel construction according to claim 15 wherein the additive consists of fiberglass particles.

17. A wheel construction according to claim 1 wherein said hub section is provided with an annular, radially projecting portion, said annular portion is provided with a plurality of circumferentially spaced openings and said tire section encases said annular portion and includes portions received within said openings in said annular portion to physically interlock said tire section to said hub section.

18. A wheel construction according to claim 17 wherein said hub section has a durometer hardness in the range of 65 to 78 Shore D and said tire section has a durometer hardness in the range of 28 to 35 Shore D.

19. A wheel construction according to claim 17 wherein said hub section has a durometer hardness of 72 Shore D and said rim section has a durometer hardness of 30 Shore D.

20. A method of making a wheel comprising:

molding a hub section of the wheel from a thermoplastic polyurethane material having a first durometer hardness; and molding a tire section from a thermoplastic polyurethane material having a second durometer hardness onto said hub section to form a molecular adhesion between said sections.

21. A method according to claim 20 wherein said hub section is formed of a material having a durometer hardness greater than the durometer hardness of the material forming the tire section.

22. A method according to claim 20 wherein said sections are formed of a polyether based polyurethane material.

23. A method according to claim 20 wherein the processing temperature of the hub portion is approximately 400° F. and the processing temperature of the rim section is approximately 400° F.

24. An in-line skate comprising:

a shoe having a sole portion;

support means secured to said sole portion and depending therefrom; and a plurality of longitudinally spaced wheels mounted on axles supported on said support means, each of said wheels comprising a hub section formed of a thermoplastic polyurethane material having a first durometer hardness and a tire section formed of a thermoplastic polyurethane material having a second durometer hardness molded onto said hub section to form a molecularly adhered, integral hub and tire structure.

25. An in-line skate according to claim 24 wherein the durometer hardness of the hub section material is in the range of 65 to 78 Shore D and the tire section material is in the range of 28 to 35 Shore D.

26. An in-line skate according to claim 24 wherein the durometer hardness of the hub section is 72 Shore D and the durometer hardness of the tire section is 30 Shore D.

27. An in-line skate according to claim 24 wherein the hub section of each wheel is provided with an annular, radially projecting portion, said annular portion is provided with a plurality of circumferentially spaced openings and the tire section thereof encases said annular portion and includes portions received in said openings provided in said annular portion.

28. An in-line skate according to claim 27 wherein the material of the hub section has a durometer hardness in the range of 65 to 78 Shore D and the material of the tire section of each wheel has a durometer hardness in the range of 28 to 35 Shore D.

29. An in-line skate according to claim 27 wherein the material of the hub section of each wheel has a durometer reading of 72 Shore D and the material of the tire section of each wheel has a durometer hardness of 30 Shore D.

* * * * *